US006708438B1

(12) United States Patent
Sorensen

(10) Patent No.: US 6,708,438 B1
(45) Date of Patent: Mar. 23, 2004

(54) CORROSION INHIBITOR FOR FIREARMS

(76) Inventor: Jeffrey Sorensen, 7103 Rye Ridge Trail, Cherry Valley, IL (US) 61016

( * ) Notice: Subject to any disclaimer, the term of this patent is extended or adjusted under 35 U.S.C. 154(b) by 0 days.

(21) Appl. No.: 08/779,361

(22) Filed: Jan. 6, 1997

(51) Int. Cl.[7] ..... F41A 17/44
(52) U.S. Cl. ..... 42/96; 42/70.11
(58) Field of Search ..... 42/96, 70.11

(56) References Cited

U.S. PATENT DOCUMENTS

| | | | | | |
|---|---|---|---|---|---|
| 2,465,163 | A | * | 3/1949 | Lockwood | 42/1 |
| 2,983,063 | A | * | 5/1961 | Douville et al. | 42/1 |
| 2,985,979 | A | * | 5/1961 | Doyle et al. | 42/1 |
| 3,382,596 | A | * | 5/1968 | Rockwood | 42/1 |
| 3,444,639 | A | * | 5/1969 | Rockwood | 42/1 |
| 3,849,923 | A | * | 11/1974 | Hawkins | 42/1 N |
| 4,084,340 | A | * | 4/1978 | Scudder | 42/1 N |
| 4,100,693 | A | * | 7/1978 | Cech | 42/1 N |
| 5,315,778 | A | * | 5/1994 | Wolford | 42/70.11 |

* cited by examiner

*Primary Examiner*—Michael J. Carone
*Assistant Examiner*—Michelle Thompson
(74) *Attorney, Agent, or Firm*—Basil Demeur; Alan Samlan; David Hurley

(57) ABSTRACT

A corrosion inhibiting device for firearms which can fit into the chamber of a firearm or stand on its end is provided. The Device has three main sections. The first section is an inner sleeve having a base which approximates the size of the rim of the shell or cartridge of a particular firearm. Extending upwardly from the rim are a plurality of arms which are circumferentially curved to approximate the shape of a firearm chamber. In between each arm is a space through which a volatile corrosion inhibitor material vapor is expelled. The second section of the Device is an outer sleeve. The outer sleeve is columnar in shape and sized so that it approximates the circumference of the shell or cartridge of a particular firearm. One end is open and fits over the upwardly extending arms of the inner sleeve, and is held in place by an O-ring found near the base of the inner sleeve. The opposite end of the outer sleeve is covered, with the exception that it has a hole formed into it. The wall of the outer sleeve has slots formed into it which equal in both size and number the spaces found in between the upwardly extending arms of the inner sleeve. The third section of the Device is a volatile corrosion inhibiting material. The material is essentially columnar in shape having a plurality of flanges extending from a central core. The material is placed on the inside of the inner sleeve, which is then covered with the outer sleeve. By turning the outer sleeve, the amount of volatile corrosion inhibitor vapor released into the firearm chamber can be adjusted.

10 Claims, 1 Drawing Sheet

CORROSION INHIBITOR FOR FIREARMS

TECHNICAL FIELD

This invention relates to corrosion inhibitors and more particularly to a volatile corrosion inhibiting device for firearms.

BACKGROUND OF THE INVENTION

Corrosion inhibitors are well-known in industry. They retard the corrosive effects of moisture and other destructive environmental elements. Corrosion inhibitors are of two general types: contact and volatile. Contact corrosion inhibitors protect surfaces from the destructive nature of corrosives which lay in contact with an item's surface, and hence volatile corrosion inhibitors protect an item's surface from the corrosive chemicals and vapors.

Corrosion inhibitors are particularly suited to retarding the pitting and tarnishing of metal objects. Most individuals are familiar with volatile corrosion inhibitors, also known as VCIs, in the form of desiccants packets found in the packing materials of metal objects and electronics. Corrosion inhibitors can also be found in impregnated materials such as paper, or chemicals or oil can be used to coat an item.

Until now, corrosion inhibitors have been used almost exclusively by manufacturers when packaging their goods. Corrosion inhibitors are not generally used by the end-user of a product despite the fact that it is after the end-user has a product that it is exposed to the most severe environmental conditions. Instead, the desiccants or other form of corrosion inhibitor found in packing material or applied to a product, is discarded. The resulting rust and pitting decreases product life and can be dangerous. This is especially true in the case of firearms inasmuch as rust or pitting on the interior of a firearm barrel can lead to serious injury or death.

Historically, firearm owners have oiled both the exterior and the interior of their firearm barrels to create a protective barrier between the metallic parts of the firearm and the volatile corrosives found in moisture containing air. This system has several drawbacks. First, if the oil is not evenly applied, uncovered spots on the metallic surface of the firearm can rust or pit. Second, before using the firearm, the firearm owner must generally wipe away any excess oil. Third, oil is difficult to work with and can soil clothing, the interior of gun cases, or other objects.

Thus, there is need for a convenient and easy to use volatile corrosion inhibiting device for use by firearm owners to protect the metallic portions of their firearms.

OBJECTS OF THE INVENTION

It is an object of the present invention is to provide a device that protects firearms from corrosion.

It is another object of the present invention to provide a corrosion inhibiting device for firearms which provides protection to the barrel interior.

It is a further object of the present invention to provide a corrosion inhibiting device for firearms in which the release of the corrosion inhibiting material can be adjusted.

SUMMARY OF THE INVENTION

The above objects are provided for in a corrosion inhibiting device for firearms which can fit into the chamber of a firearm or stand on its end. According to the invention, the Device has three main sections. The first section is an inner sleeve having a base which approximates the size of the rim of the shell or cartridge of a particular firearm. Extending upwardly from the rim are a plurality of arms which are circumferentially curved to approximate the shape of a firearm chamber. In between each arm is a space through which a volatile corrosion inhibitor material vapor can expell.

The second section of the Device is an outer sleeve. The outer sleeve is columnar in shape and sized to approximate the circumference of the shell or cartridge of a particular firearm. One end is open and fits over the upwardly extending arms of the inner sleeve, and is held in place by an O-ring found near the base of the inner sleeve. The opposite end of the outer sleeve is covered, with the exception that it has a hole formed into it. The wall of the outer sleeve is smooth and has slots formed into it which equal in both size and number the spaces found in between the upwardly extending arms of the inner sleeve.

The third section of the Device is a volatile corrosion inhibiting material. The material is essentially columnar in shape preferably having a plurality of flanges extending from a central core.

The Device is used by placing the material inside the inner sleeve, then placing the open end of the outer sleeve over the inner sleeve until it comes in contact with the base of the inner sleeve. Turning the outer sleeve adjusts the amount of volatile corrosion inhibitor vapor released into the firearm chamber by varying the alignment of the spaces of the inner sleeve and the slots of the exterior sleeve. The Device is then placed into the chamber of a firearm or stood on its end near the item to be protected from corrosion.

DETAILED DESCRIPTION OF THE PREFERRED EMBODIMENT

Figure 1:
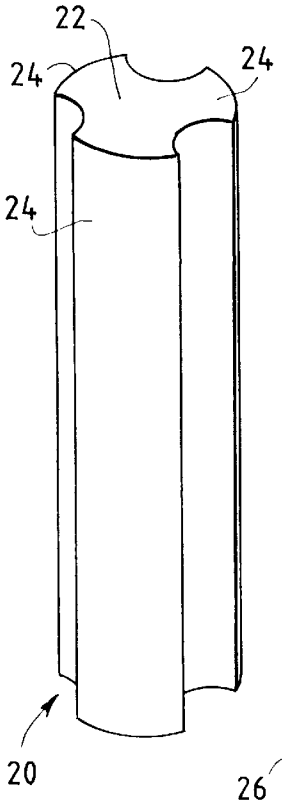
FIG. 1 depicts a core sleeve.

Turning to FIG. 1, a core sleeve of corrosion inhibiting material 20 is seen. The material must be capable of retaining sufficient amounts of corrosion inhibiting ability such that the device will remain in an activated state for several months. The material chosen must also be able to retain its shape for smooth operation of the device.

Volatile corrosion inhibiting materials such as Fero-Park, MPI 50# kraft paper manufactured by Cromwell-Phoenix of Chicago, Ill., is an example of a preferred corrosion inhibiting material. It has the properties of good shape retention, low odor, long lasting corrosion inhibiting effectiveness, and is effective for a wide range of ferrous and non-ferrous metals and alloys.

The core sleeve preferably has an inner cylindrical portion 22 which extend the full length of the device. Protruding from the inner portion are a plurality of flanges 24 which are co-formed to the center core. The core sleeve can be impregnated with a volatile corrosion inhibiting substance or, preferably, will have a corrosion inhibiting paper affixed to it.

While a cylindrical-flanged core sleeve is preferred, other shapes are also contemplated, including a free-form wad of material such as cotton. However, as noted above, these alternate shapes are not as effective as a cylindrical-flanged core sleeve for the reasons that they decrease the effectiveness of the Device.

Figure 2:
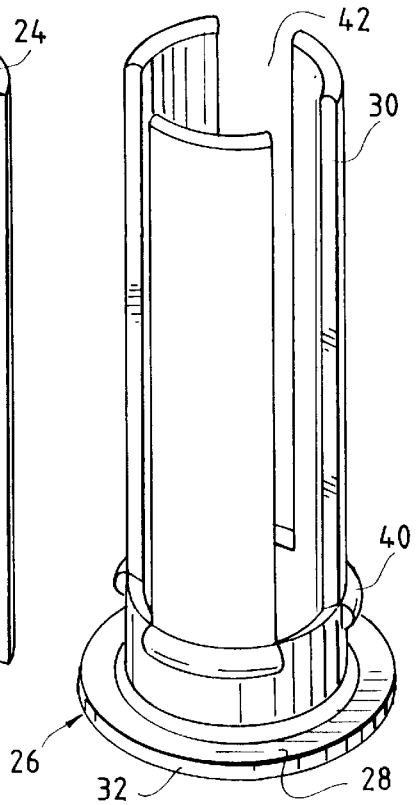
FIG. 2 depicts a side view of an inner sleeve.
Figure 3:
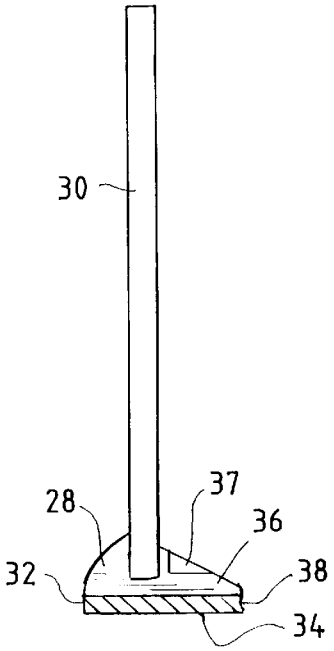
FIG. 3 depicts a cutaway view of an inner sleeve illustrating the flat bottom and inner depression.

Turning to FIG. 2, an inner sleeve 26 is depicted. The inner sleeve has a base 28 from which a plurality of arms 30 upwardly extend. The base is circular in shape and should approximate the size of the base of the shell or cartridge that would normally be used in a particular firearm. As seen in FIG. 3, the bottom of the base 34 is flat so that the Device may be stood on its end if use is desired outside of a firearm or for storage. The upper surface 36 of the base has a depression molded into it to prevent liquefied corrosion inhibiting material from leaking out of the Device when it is stood on end.

The upwardly extending arms 30 are co-formed to the base 32 at a distance from the center 38 of the base such that the outer sleeve (described below) can fit over them, leaving a portion exposed, creating a rim 32. When the Device is inserted into the chamber of a firearm, the rim 32 prevents the Device from becoming lodged into the barrel of the firearm (not shown), where it cannot be extracted.

In between the upwardly extended arms 30 are found spaces 42 through which the volatile corrosion inhibiting material vapors are expelled. Near the base end of the upwardly extending arms 30 is found an O-ring 40 which fits over the exterior of the upwardly extending arms 30 near the rim 32. The O-ring functions to hold the exterior sleeve (described below) in place.

Figure 4:
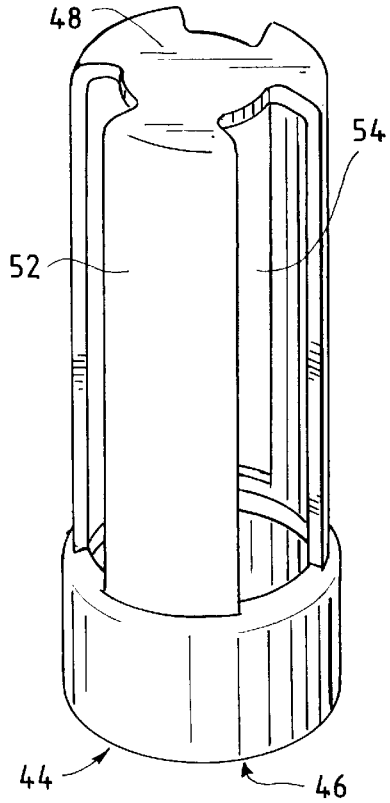
FIG. 4 depicts an exterior sleeve.
Figure 5:
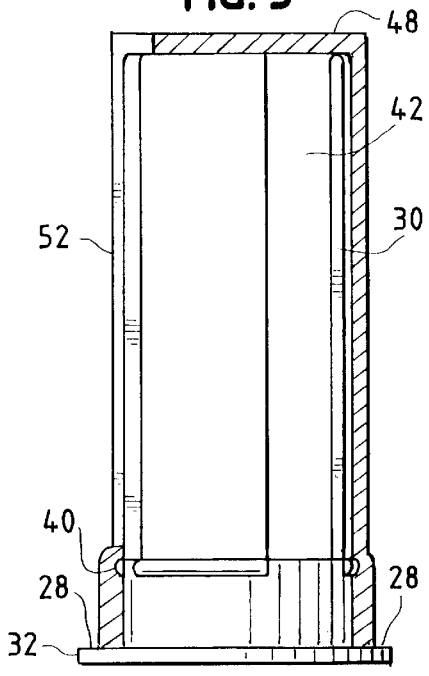
FIG. 5 depicts a side view cutaway of an assembled Device.

Turning to FIG. 4, the exterior sleeve 44 is depicted. The exterior sleeve is cylindrical in shape, the shape approximating the exterior circumference shape of the shell or cartridge of a particular firearm. One end of the exterior sleeve is open 46, while the other end is closed 48, but does have a hole 50 formed through its entirety. The outer surface 52 of the exterior sleeve 44 is smooth. The exterior sleeve has slots 54 formed into it. Slots 54 are of a number and size to equal the spaces 42 of the inner As depicted in FIG. 5, during use of the Device, as the exterior sleeve 44 is rotated about the interior sleeve 26, are formed by the spaces 42 in between the upwardly extending arms of the interior sleeve 26 and the slots of the exterior sleeve 44. By rotating the exterior sleeve against the interior sleeve, the size of the exposed channel, and thus the amount of volatile corrosion inhibiting material released from the device, can be adjusted.

To practice the Device, O-ring 40 is placed around the outside of the upwardly extending arms into a molded into the outer surface of the inner sleeve 26 near its base 28. Core sleeve 20 is then placed inside of inner sleeve 26. Exterior sleeve 44 is then fit over the upwardly extending arms 30 of the inner sleeve and slid down until its open end 46 meets the base 28 of inner sleeve 26. The O-ring holds the exterior sleeve in place, yet allows rotation of the exterior sleeve about the inner sleeve.

The Device can be adjusted by rotating the exterior sleeve about the inner sleeve, creating a channel size sufficient to handle the corrosion inhibiting needs of the user. Once the channel is adjusted, the Device is merely slipped into the chamber of the desired firearm. The corrosion inhibiting materials found within the inner core then expel through the channels.

The Device will be manufactured in various sizes to accommodate particular firearms. For example, the device may be manufactured in a size to fit a 12 gauge shotgun, a 20 gauge shotgun, 30-.06 rifle, or a handgun. Relying on the flat bottom of the Device, it may also be stood on its end and placed inside of a gun cabinet to prevent corrosion of the outer surfaces of firearms. The depression in the base of the Device will prevent liquefied corrosion inhibiting material from leaking.

The Inventor also contemplates use of the Device outside of the realm of firearms. For instance, by use of a Velcro® strap, the Device may be adhered to the interior of a fishing tackle box to keep moisture from corroding expensive lures and fishing tackle. Alternatively, the Device may merely be set into one of the internal compartments of a fishing tackle box. Another non-limiting example is use of the device by adhering it inside of a golf club case for the prevention of corrosion to golf clubs. It is to be understood, however, that the present invention may be used to protect other metallic objects such as tools, tool boxes, and other metallic objects which may be exposed to corrosive vapors.

The above description of the preferred embodiment is for illustration purposes only. Those skilled in the arts will readily see additional uses for the device which should be limited only by the appended claims.

I claim:

1. A volatile corrosion inhibiting device for firearms comprising:

an inner sleeve;

an exterior sleeve sized to fit over the inner sleeve; and means for dispensing volatile corrosion inhibiting materials disposed within the inner sleeve.

2. The volatile corrosion inhibiting device of claim 1 wherein the inner sleeve further comprises means for securing the exterior sleeve snug to the interior sleeve.

3. The volatile corrosion inhibiting device of claim 2 wherein the means for securing the inner sleeve is an O-ring.

4. The corrosion inhibiting device of claim 1 wherein the exterior sleeve is cylindrical in shape and sized such that its interior circumference will fit around upwardly extending arms of the inner sleeve, an outer surface which is smooth, an opened end, a closed end having a hole formed through it, and a plurality of slots equal to the number of upwardly extending arms of the inner sleeve formed into its inner surface.

5. The volatile corrosion inhibiting device of claim 1 wherein the corrosion inhibiting materials release a corrosion inhibiting vapor.

6. A corrosion inhibiting device for firearms comprising:

a corrosion inhibitor impregnated material;

an inner sleeve having a base portion from which a plurality of upwardly extending arms are co-formed in such a manner that a rim is created to the exterior of the plurality of upwardly extending arms, spaces being formed in between the upwardly extending arms and;

an exterior sleeve being cylindrical in shape and sized to fit over the the upwardly extending arms, having an open end, a closed end, the closed end having a hole formed through its entirety, and slots formed into its wall, whereby the corrosion inhibitor impregnated material is placed inside the upwardly extending arms of the inner sleeve, and the exterior sleeve is fit over the upwardly extending arms, and by rotation of the exterior sleeve against the inner sleeve, channels are created through which a volatile corrosion inhibitor may expel.

7. A method for inhibiting the corrosion of firearms comprising the steps of:

placing a corrosion inhibitor impregnated material into the central area of an inner sleeve having a plurality of upwardly extending arms projecting from a base, placing an external sleeve having slots formed along its length over the outer surface of the upwardly extending arms of the inner sleeve, rotating the external sleeve against the upwardly extending arms of the inner sleeve to create channels through which the volatile corrosion inhibitors may travel, placing the device comprised of the volatile corrosion inhibitors impregnated material, inner sleeve, and external sleeve, into the chamber of a firearm.

8. A volatile corrosion inhibiting device for firearms comprising:

an inner sleeve which has a base having an upper surface and a center point from which a plurality of upwardly extending arms are co-formed at a distance from the center point of the upper surface of the base such that a rim is formed and spaces between the arms;

an exterior sleeve sized to fit over the inner sleeve; and means for dispensing volatile corrosion inhibiting materials disposed within the inner sleeve.

9. A volatile corrosion inhibiting device for firearms comprising:

an inner sleeve which has a base having an upper surface and a center point from which a plurality of upwardly extending arms are co-formed at a distance from the center point of the upper surface of the base such that a rim is formed and spaces between the arms, wherein the upper surface has a depression central to the upwardly extending arms;

an exterior sleeve sized to fit over the inner sleeve; and means for dispensing volatile corrosion inhibiting materials disposed within the inner sleeve.

10. A volatile corrosion inhibiting device for firearms comprising:

an inner sleeve;

an exterior sleeve sized to fit over the inner sleeve; and means for dispensing volatile corrosion inhibiting material disposed within the inner sleeve, wherein said means for dispensing corrosion inhibiting materials is columnar in shape and contains a plurality of flanges extending along its length.

* * * * *